United States Patent [19]

Tipps et al.

[11] Patent Number: 4,844,674

[45] Date of Patent: Jul. 4, 1989

[54] CASSETTE FOR BOOKBINDING STRIPS

[75] Inventors: Barney A. Tipps, Sparks, Nev.; Frank A. Todaro, Clinton, Conn.

[73] Assignee: Velo Bind, Inc., Hayward, Calif.

[21] Appl. No.: 115,999

[22] Filed: Nov. 2, 1987

[51] Int. Cl.[4] ..... B42B 5/14; B42B 5/08; B42F 13/00; B42F 1/00

[52] U.S. Cl. ..... 412/43; 412/38; 402/80 P; 24/67 P

[58] Field of Search ..... 412/33, 38, 43, 6, 17, 412/16; 402/22, 60, 63, 68, 80 P; 281/15 R, 21 A, 21 R; 354/275; 206/455; 430/471

[56] References Cited

U.S. PATENT DOCUMENTS

| | | | |
|---|---|---|---|
| 3,811,146 | 5/1974 | Abildgaard et al. | 412/43 |
| 4,293,366 | 10/1981 | Szanto et al. | 412/43 |
| 4,369,013 | 1/1983 | Abildgaard et al. | 412/38 |
| 4,620,724 | 11/1986 | Abildgaard et al. | 412/43 |
| 4,674,906 | 6/1987 | Abildgaard | 412/43 |
| 4,708,560 | 11/1987 | Abildgaard et al. | 412/43 |
| 4,770,970 | 6/1981 | Szanto et al. | 412/43 |

*Primary Examiner*—Frank T. Yost
*Assistant Examiner*—Paul M. Heyrank
*Attorney, Agent, or Firm*—Julian Caplan

[57] ABSTRACT

For convenient packaging of plastic bookbinding strips, cassettes are provided. The end edges of each strip are received in channels formed in opposed side rails. The rails engage adjacent either end the depending legs of transverse spacer bars. The spacer bars have plural sockets to engage projections on the upper ends of the legs so that the spacing between side rails may be varied to accommodate strips of different lengths—e.g., 8½ inches, 11 inches, etc. Different length legs may be used to accommodate different length studs formed on the strips. By eliminating the legs entirely, flat female binding strips may be packaged in the cassette. A detent is provided in the ends of the rails preventing removal of strips until the detent is bent out of position. The cassette is especially useful in equipment which mechanically assembles punched sheets and strips preparatory to binding a book in a binding machine.

18 Claims, 2 Drawing Sheets

Fig. 1
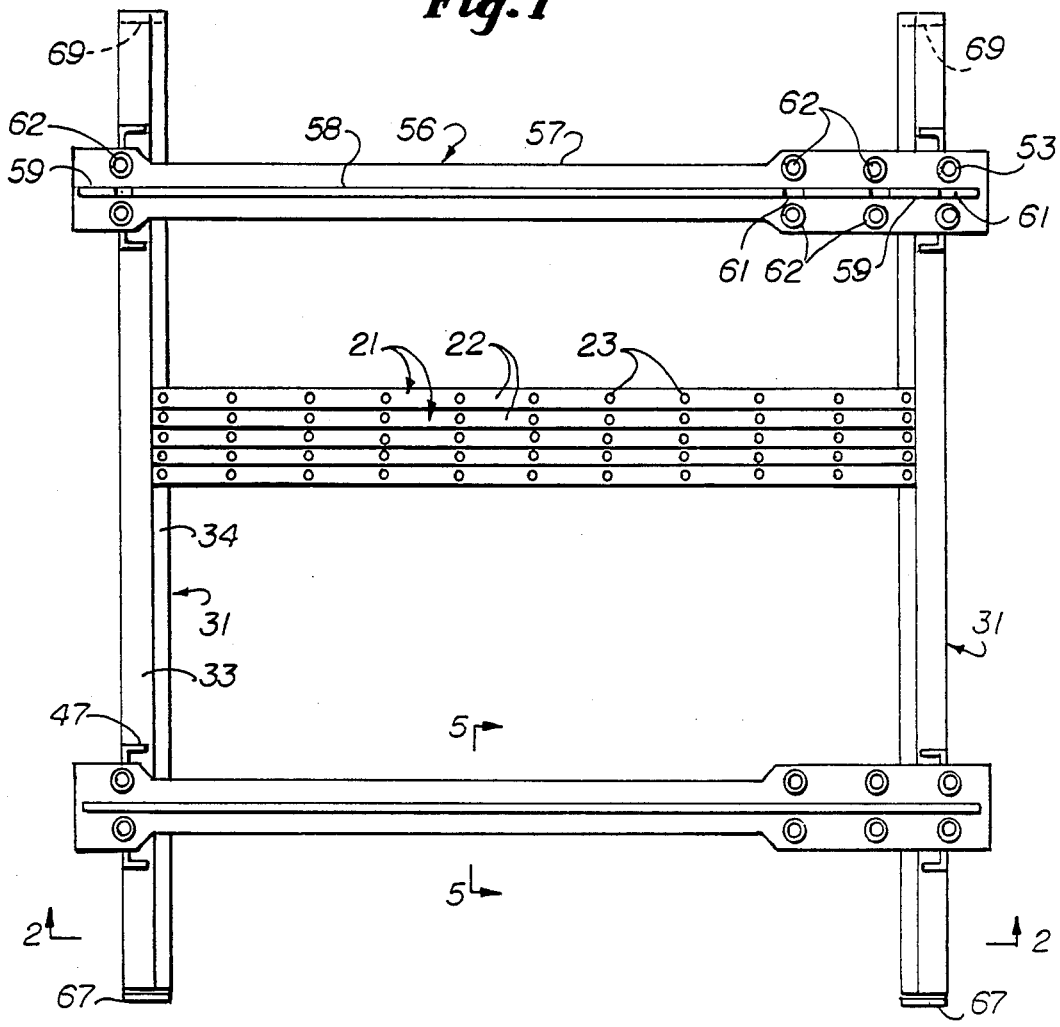
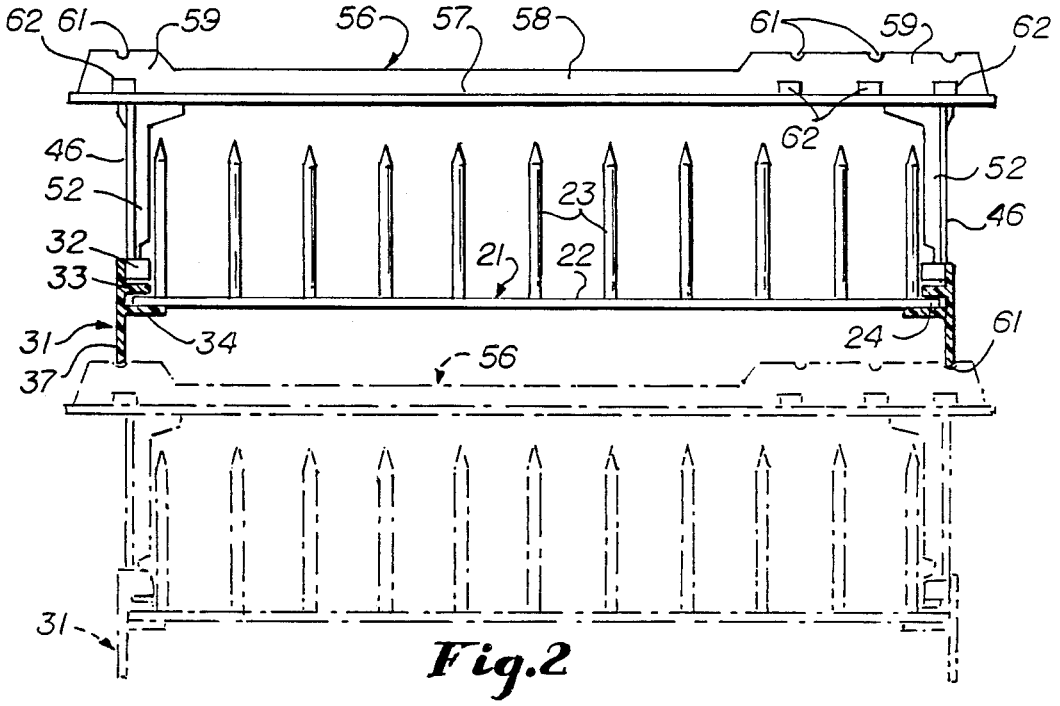
Fig. 2

CASSETTE FOR BOOKBINDING STRIPS

BACKGROUND OF THE INVENTION

1. Field of the Invention

This invention relates to a cassette for packaging bookbinding strips of the type shown in FIG. 1 of U.S. Pat. No. 4,369,013. The cassette may be used in equipment for binding books wherein the binding strips are mechanically fed into the equipment preparatory to binding by means of equipment such as that shown in U.S. Pat. No. 3,811,146. However strips may be removed from the cassette hereinafter described manually for manual insertion into such equipment.

2. Description of Related Art

The cassette hereinafter described is constructed so as to package a plurality of strips such as those heretofore described, such strips being a well-known means for binding books and documents. Heretofore such strips have been commercially packaged in boxes but have not been so packaged that they may be automatically fed into proper position for assembly of a book or a document preparatory to binding same. The present invention provides a cassette wherein the strips are arranged in side-by-side relationship and discharged from one end of the cassette into receiving means for transfer into a position whereby they may be assembled with punched sheets of paper so that the completed document or book may be bound.

Cartridge packaging of said strips is shown in FIGS. 6–10A of said U.S. Pat. No. 4,369,013, but in an entirely different manner from the present invention.

SUMMARY OF THE INVENTION

Binding strips of the type shown in U.S. Pat. No. 4,369,013 comprise a set of two strips. The first strip is formed of narrow thermoplastic material and has integral studs projecting therefrom at spaced intervals. The length of the strips are varied to accommodate different widths of paper and the stud lengths are variable to accommodate different thicknesses of books or documents. The second strip of the set is flat and narrow and has holes spaced at the same intervals as the studs. Again, the length of the strip is variable and the hole spacing is variable to accommodate the studs of the first strip. Such strips are well known in the binding industry. Heretofore such strips have been molded and transported in boxes. At the time of use, the strips have been removed from the boxes one at a time and inserted in bookbinding means of the type shown in U.S. Pat. No. 3,811,146 as well as other binding machines produced by the assignee of this application. The present invention is a means for packaging said strips so that they are more conveniently available for insertion in the bookbinding machine and, indeed, may be automatically discharged from the cassette and transported into proper position for assembly of a book or document prior to the binding thereof.

One of the features of the invention is that it accommodates both the first strips and the second strips heretofore mentioned and accommodates strips of different lengths and also first strips of different stud heights. Merely by adding spacers to the cassette assembly used for the second or flat strips, first strips may be accommodated and the lengths of the spacers make it possible to accommodate first strips of different stud lengths.

Thus considerable economy in the manufacture of the cassettes is achieved.

Furthermore, since strips of different lengths are used, the cassette hereinafter described may be fabricated in such a way that it can be assembled to accommodate strips of different lengths.

When male strips are being packaged, the cassette protects the studs from being bent out of alignment.

The cassette is intended for use in equipment which automatically advances strips longitudinally of the cassette. The structure of the cassette is such that it provides no obstructions to the portion of such equipment which engages the strips to so advance the same.

Other objects of the present invention will become apparent upon reading the following specification and referring to the accompanying drawings in which similar characters of reference represent corresponding parts in each of the several views.

IN THE DRAWINGS:

FIG. 1 is a top plan view of a cassette in accordance with the present invention.

FIG. 2 is an end elevational view thereof showing additionally in dot and dash lines a second cassette upon which the first is stacked.

DESCRIPTION OF PREFERRED EMBODIMENTS

Figure 3:
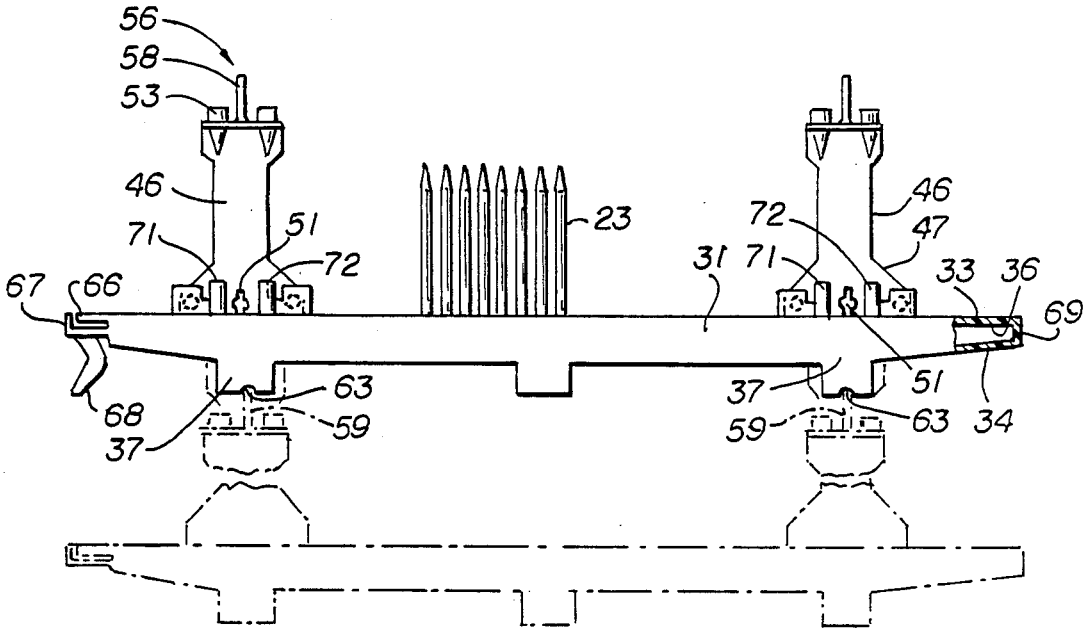
FIG. 3 is a side elevation of the structure of FIG. 2.

The cassette hereinafter described in detail is used to package bookbinding strips. First strips 21 have a base 22 which is a thin narrow elongated strip of thermoplastic material from which project integral studs 23. The length of the base 22 and the heights of the studs 23 vary and the cassette hereinafter described accommodates different lengths of strips and heights of studs. The ends 24 of base 22 of commercially available strips 21 extend outward of the outermost stud 23, and this projecting end 24 is a feature which is taken advantage of in the construction of the cassette. With each first strip 21 there is used a second strip 26 which has holes at intervals spaced the same distances as the studs 23 and the strip 26 preferably has the same length as the base 22.

Figure 5:
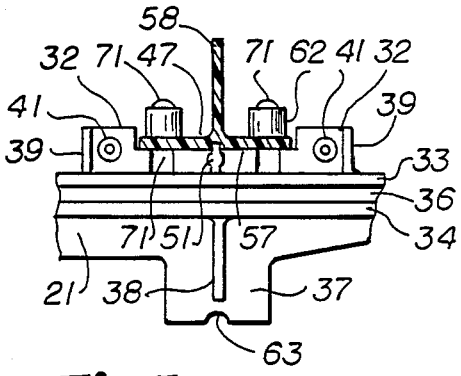
FIG. 5 is a fragmentary sectional view taken substantially along the line 5—5 of FIG. 4.
Figure 6:
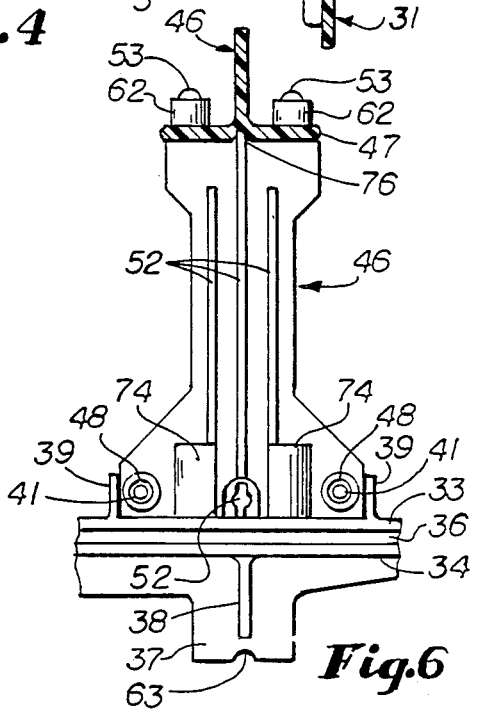
FIG. 6 is an enlarged fragmentary view similar to FIG. 5 showing spacers in place to accommodate male strips.
Figure 7:
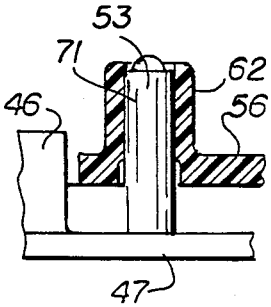
FIG. 7 is a fragmentary sectional view taken substantially along the line 7—7 of FIG. 4.

On either side of the cassette are inward facing side rails 31 which are of a length to accommodate a plurality of strips 21 or 26. At locations spaced inward but adjacent to the ends of rails 31 are upward projecting connector members 32. Extending the entire length of each rail 31 are upper and lower longitudinal guides 33, 34 between which is a channel 36 having the width of the thickness of base 22 or strip 26 and deep enough to receive the ends 24 of strips 21 or the ends of strips 26. At intervals along the length of rail 31 are downward projections 37 which are rectangular in shape. Three such projections are shown in FIG. 3 but the number of such projections is subject to variation. A gusset 38 interconnects the bottom of lower guide 34 and the projection 37 to reinforce the same. To either side of connector members 32 are locators 39 for the spacer legs hereinafter described and projecting inward of each such connector member 32 is a horizontally disposed pin 41 to effect connection with such leg. When female strips 26 are packaged, no vertical spacer legs 46 are required. However when packaging male strips 21, a plurality of legs 46 are used. The lengths of the legs 46 depend upon the lengths of the studs 23. Hence the legs 46 are an interchangeable parts for the completed cassette. Spacer leg 46 has a base 47 which extends longitudinally outwardly and at the lower corners of the base 47 are sockets 48 which receive the pins 41 in a snap in arrangement. Thus the base 47 is positioned between the spacers 39. Vertical reinforcement ribs 52 rigidify the legs 46. On the upper ends of legs 46 are vertically disposed connector pins 53 which fit into sockets 62 on bars 56 when legs 46 are used. As shown in FIG. 5, when packaging strips 26 (when no legs 46 are used) pins 71 on rails 31 fit into sockets 62. When legs 46 are used, pins 71 fit into grooves 73 on the outside of leg 46, there being bosses 74 on the inside to define said grooves. To further stabilize the assembled cassettes, inverted U-shaped rib receptors 64 are formed at the bottom of the central reinforcement 52 and projection 51 on the top of rails 31 slides into said receptors when pins 41 slide into sockets 48. Further, the upper edge of central reinforcing rib 52 fits into groove 76 on the underside of interconnecting bar 56 (see FIG. 6).

Extending transversely of the cassette adjacent but spaced inward of either end of rail 13 is a horizontal interconnector bar 56. Such bar 56 has a base 57 having a central longitudinally upwardly extending reinforcing rib 58 and the rib 58 at either end has an upward extension 59. The upper edge of each extension 59 is formed with notches 61 and to either side of extension 59 are sockets 62. As best seen in FIGS. 1 and 2, on the left side of each bar 56 there is a single notch 61 and to either side thereof is a single socket 62. On the right-hand side of each bar 56 are three notches 61 and to either side of each notch is a socket 62. This arrangement makes it possible to fabricate the cassette so that a single size bar 56 will accommodate strips 21 or 26 of different lengths. Thus the innermost sockets 62 on the right-hand side may accommodate strips which are 8½ inches in length, the middle sockets 62 strips which are 11 inches in length and the outermost sockets 62 strips which are 14 inches in length. Of course the number and spacing of the sockets 62 is subject to variation. The connector pins 53 for the legs 46 fit into the sockets 62 and are positioned in the selected socket 62 so that the cassette formed will accommodate the desired length of strip. As best shown in FIG. 2, the notches 61 receive the bottom projections 37 so that a plurality of cassettes may be stacked on top of each other and aligned by reason of the projections 37 fitting into the notches 61. Notches 63 are formed on the bottom edges of projections 37. When stacked as in FIG. 3, the upper extension 59 of the undermost cassette fits into notch 63 to promote stacking stability.

Figure 8:
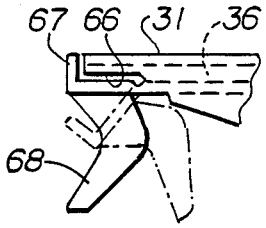
FIG. 8 is an enlarged fragmentary view showing a detent which is removed at the time strips are discharged from the cassette.

As best shown in FIG. 8, as an optional feature, a slot 66 is formed in the end of each side rail 31 and a retainer detent 67 prevents strips from being forced out of the channels 36. Such detent 67 closes off the end of channel 36. A lever 68 connected to the rail 31 below the slot 66 may be bent from the solid line position of FIG. 8 to the dot and dash line position, thereby bending the detent 67 out of the way of channel 36 and permitting the strips to be discharged from the channels 36. It will be understood that when the cassettes are used in automatic machinery, when the cassette is inserted into the machine, an abutment (not shown) contacts the lever 68 and bends it down to the dot and dash line position of FIG. 8 so that the strips may be fed out of the cassette for assembly with perforated sheets to be bound.

The end of each channel 36 opposite detent is blocked by a permanent stop 69 which prevents removal of strips 21 or 26 until detents 67 are bent down.

Figure 4:
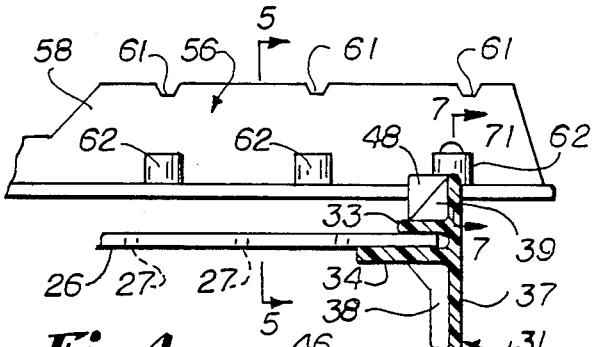
FIG. 4 is a fragmentary sectional view of a portion of FIG. 2 with the spacers eliminated so that flat female strips are packaged.

To load the cassette, opposed rails 31 are sprung apart sufficiently for strips to be loaded. Alternatively, the strips may be loaded before all elements of the cassette are snapped together. When the rails are released they move together, holding the strips therebetween. FIGS. 4 and 5 illustrate that by connecting the rails 31 directly to the interconnecting bars 56 flat female strips 26 may be supported in the cassette. For such purpose, connector pins 71 which are formed on the rails 31 are received directly in the sockets 62 on the transverse bars 56. By inserting pins 71 in the appropriate sockets 62, the effective width of the cassette may be changed to accommodate strips 21 or 26 of different lengths.

In order to accommodate male strips 21, a leg 46 of appropriate height is used. For such purpose, the pins 41 of the rail 31 are inserted in the appropriate sockets 48 in the legs 46. The pins 53 on the upper ends of the legs 46 are inserted in the appropriate socket 62 in the connecting bar 56 depending on the length of strip 21 being packaged and projections 51 slide into receptor 64. The foregoing arrangement makes it possible to use a set of rails 31 and a set of bars 56 to package female strips 26 of any length as well as male strips of any length and the height of the studs 23 of the male strip is accommodated simply be selecting spacer legs 46 of appropriate height.

What is claimed is:

1. A cassette for bookbinding strips comprising opposed horizontal side rails each formed with an inward facing horizontal channel shaped to receive the ends of a plurality of thin, narrow strips, each said rail having a plurality of upward extending connectors each having first connector means, and at least two horizontal interconnecting bars disposed transverse to said side rails, each said bar having at least two spaced second connector means cooperable with said first connector means to secure said cassette with said rails parallel and fixed a selected distance apart, whereby a plurality of bookbinding strips may be packaged side by side transverse to said side rails with opposed ends received in opposed channels.

2. A cassette according to claim 1 in which each said bar has at least three said second connector means, whereby one of the first connector means of one of said rails may be assembled in one of the second connector means and the other of said first connector means of the other said rail may be assembled in either of the other two second connector means and thereby the distance between said rails may be varied to accommodate strips of different lengths.

3. A cassette according to claim 1 which further comprises a detent on each said rail positioned to block discharge of strips from said channel and a lever operable to move said detent away from said channel.

4. A cassette according to claim 1 in which each said rail has a thin downward projection and each said bar has a longitudinally extending rib formed on its upper edge with notches at substantially the same intervals as said second connector means, whereby one cassette may be stacked on an underlying cassette by the downward projections of the superimposed cassette resting inside notches of the underlying cassette.

5. A cassette according to claim 1 in which each said rail at its midpoint has a thin, longitudinal, downward projection formed with a notch and each bar has a thin, longitudinally extending rib, whereby one said cassette may be stacked on an underlying cassette by said rib of the underlying cassette fitting into the notch of the superimposed cassette.

6. A cassette according to claim 1 in which said first connector means are upward extending vertical pins and said second connector means are downward opening sockets shaped to fit over said vertical pins with a friction-tight fit.

7. A cassette according to claim 1 which further comprises a pair of vertically disposed spacer legs for each said bar, said legs having third connector means at its lower end and fourth connector means at its upper end, each said rail having fifth connector means cooperable with said third connector means to secure said legs to said rail positioned upright, said fourth connector means being cooperable with said second connector means to secure said bar perpendicular to said leg and transverse to said rails and spaced therefrom a fixed distance.

8. A cassette according to claim 7 in which said spacer legs are interchangeable with legs of different said bars relative to said rails may be varied to accommodate strips having upward projecting studs of different lengths.

9. A cassette according to claim 7 in which each said bar has at least three said second connector means, whereby one of said fourth connector means of a first said leg connected to a first said rail may be assembled in one of said second connector means and another said fourth connector means of a leg connected to a second said rail opposite said first rail may be assembled in either of the other two second connector means and thereby the distance between said rails may be varied to accommodate strips of different lengths.

10. A cassette according to claim 7 in which said fifth connector means comprises horizontal inward extending pins and said third connector means comprises horizontal sockets shaped to fit over said horizontal pins with a friction-tight fit.

11. A cassette according to claim 7 in which said fourth connector means comprises inward extending vertical pins and said second connector means are downward opening sockets shaped to fit over said vertical pins with a friction-tight fit.

12. A cassette for packaging bookbinding strips of the type having thin narrow bases comprising first means formed with longitudinally-extending, inwardfacing channels dimensioned to receive the ends of said bases so that said strips may be loaded into said first means in side-by-side relation and fed longitudinally of said first means; second means extending transversely of said first means; first connecting means on said second means adapted to engage with said first connecting means to space and secure said channels apart a distance equal to the lengths of said strips.

13. A cassette according to claim 12 which further comprises a plurality of third means having third connecting means at one end thereof and fourth connecting means at a second end opposite said first end, said first means having fifth connecting means cooperable with said third connecting means to secure said third means upright perpendicular to said channels, said second and fourth connecting means being cooperable to secure said second means to said third means in perpendicular relation.

14. A cassette according to claim 13 in which said third means are of different lengths and are interchangeable to space said first and second means different distances apart to accommodate strips having upright studs of different lengths.

15. A cassette according to claim 12 in which there are a plurality of second connecting means on said second means at different locations thereon, whereby said first connecting means may engage different second connecting means to space said channels different distances apart to accommodate strips of different lengths.

16. A cassette according to claim 12 in which the bottom of said first means and the top of said second means have interfitting stacking means where cassettes may be stacked on top of each other and held against relative movement.

17. A cassette according to claim 12 which further comprises at least one detent hingedly connected to one end of said first means positioned to block at least one said channel to restrain discharge of strips from said first means and means for moving said detent to inoperative position.

18. A cassette according to claim 12 wherein said second means is located above the back of said channels, whereby an instrument pushing strips longitudinally of said channels is unobstructed by said second means.

* * * * *